US009546630B2

(12) United States Patent
Maeurer et al.

(10) Patent No.: US 9,546,630 B2
(45) Date of Patent: Jan. 17, 2017

(54) INJECTION VALVE

(71) Applicant: Robert Bosch GmbH, Stuttgart (DE)

(72) Inventors: Walter Maeurer, Korntal-Muenchingen (DE); Anselm Berg, Ludwigsburg (DE); Friedrich Moser, Magstadt (DE); Philipp Rogler, Stuttgart (DE); Juergen Graner, Sersheim (DE); Olaf Schoenrock, Stuttgart-Weilimdorf (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/429,466

(22) PCT Filed: Jul. 26, 2013

(86) PCT No.: PCT/EP2013/065812

§ 371 (c)(1),
(2) Date: Mar. 19, 2015

(87) PCT Pub. No.: WO2014/048609

PCT Pub. Date: Apr. 3, 2014

(65) Prior Publication Data

US 2015/0247479 A1 Sep. 3, 2015

(30) Foreign Application Priority Data

Sep. 25, 2012 (DE) ..... 10 2012 217 322

(51) Int. Cl.
*F02M 51/06* (2006.01)

(52) U.S. Cl.
CPC ..... *F02M 51/0685* (2013.01); *F02M 51/066* (2013.01); *F02M 2200/07* (2013.01); *F02M 2200/306* (2013.01)

(58) Field of Classification Search
CPC ..... F02M 51/066; F02M 51/0685; F02M 2200/03;F02M 2200/07; F02M 2200/26; F02M 2200/306
See application file for complete search history.

(56) References Cited

U.S. PATENT DOCUMENTS 6,367,769 B1 * 4/2002 Reiter ..... F02M 51/0671 239/585.5
6,520,434 B1 * 2/2003 Reiter ..... F02M 51/0685 239/533.11

(Continued)

FOREIGN PATENT DOCUMENTS

DE 198 49 210 4/2000
EP 2 325 473 5/2011

(Continued)

OTHER PUBLICATIONS

International Search Report for PCT/EP2013/065812, dated Oct. 21, 2013.

*Primary Examiner* — Darren W Gorman
(74) *Attorney, Agent, or Firm* — Norton Rose Fulbright US LLP; Gerard Messina

(57) ABSTRACT

An injection valve for injecting fuel into a combustion chamber includes: a housing having at least one spray discharge orifice on a discharge side; a solenoid coil; a magnet armature linearly movable by the solenoid coil; a valve needle for opening and closing the spray discharge orifice, which valve needle projects through the magnet armature and is linearly movable along a longitudinal axis, the magnet armature being linearly movable in relation to the valve needle between a first stop and a second stop, the second stop being formed by a stop element having a stop face and a counter element having a counter face situated opposite the stop face, the stop element having an elastic design so that an angle between the longitudinal axis and the stop face is changed when the counter face strikes the stop face.

13 Claims, 11 Drawing Sheets

(56) References Cited

U.S. PATENT DOCUMENTS

| | | | | |
|---|---|---|---|---|
| 6,799,734 | B1 * | 10/2004 | Hans | F02M 51/0685 239/585.1 |
| 2002/0063173 | A1 * | 5/2002 | Spakowski | F02M 51/0625 239/585.1 |
| 2003/0155440 | A1 * | 8/2003 | Reiter | F02M 51/0685 239/533.2 |

FOREIGN PATENT DOCUMENTS

| | | |
|---|---|---|
| EP | 2 634 413 | 9/2013 |
| JP | 2000 265919 | 9/2000 |
| JP | 2007-224811 A | 1/2006 |
| WO | WO 2004/055357 | 7/2004 |

* cited by examiner

INJECTION VALVE

BACKGROUND OF THE INVENTION

1. Field of the Invention

The present invention relates to an injection valve for injecting a medium, e.g., for injecting fuel into a combustion chamber, which injection process may be developed as a port injection or as a direct injection.

2. Description of the Related Art

The related art includes known injection valves for the injection of Otto fuel. They have a valve needle which is moved against a closing spring by an actuator, e.g., an electromagnet or a piezo actuator, in such a way that a desired fuel quantity is selectively introduced directly into the combustion chamber. In the case at hand, an injection valve is examined in which the magnetic armature is decoupled from the valve needle. When the injection valve is opened, the magnetic armature is meant to rapidly detach from the lower stop (second stop) on the valve needle, to rapidly overcome the armature free travel, and to quickly open the valve when striking the upper (first) stop. If the energization of the valve is stopped, then the valve needle closes again. Once the valve needle seals the valve seat again, the magnetic armature continues its movement until it strikes the lower stop. The armature bounces off the lower stop multiple times before reattaining its idle position. The time until the magnet armature is reset to the idle position again is decisive for the ability of the valve to deliver injections in rapid succession and with high accuracy. A squish gap is usually developed at the lower stop, i.e., between the magnetic armature and the corresponding stop sleeve on the valve needle. The medium to be injected is squeezed into this squish gap, so that the magnetic armature is reset to the idle position in a damped and rapid manner during the closing. However, by damping the movement during the opening, the squish gap prevents a rapid opening. As a compromise, the squish gap must therefore be configured in such a way that the magnet armature opens the valve with sufficient speed and is reset to its idle position with sufficient speed as well.

BRIEF SUMMARY OF THE INVENTION

The injection valve of the present invention allows for better damping of the magnet armature and thus makes it possible to reset the magnet armature to its idle position more rapidly than previously possible after the injection valve is closed. At the same time, the damping during the opening of the injection valve is reduced in the present invention, so that the injection valve opens more rapidly. More specifically, the following advantages thus result in the opening of the injection valve: The magnet armature detaches from the valve needle more rapidly than previously, which increases the dynamic response of the valve and therefore improves the function. The required opening force is reduced, so that the current consumption of the injection valve, and thus the entire energy requirement of the vehicle, is lower. This lowers the consumption of the vehicle. The following advantages result in the closing of the injection valve: The movement of the magnet armature is damped to a greater extent than before. The magnet armature therefore reaches its idle position earlier than previously, so that injections are able to be delivered in rapid succession and with high repeat accuracy. The injection valve according to the present invention provides new injection strategies that make possible a combustion featuring lower pollutant emissions and lower consumption. The better damping in the closing of the injection valve reduces the noise that is created by the pulse transmission of the magnet armature to the valve needle. All of these advantages are achieved by an injection valve according to the present invention, which includes a housing having at least one spray-discharge orifice on a discharge side, a solenoid coil and a magnetic armature, which is linearly movable with the aid of the solenoid coil. In addition, the injection valve has a valve needle. This valve needle is used for the opening and closing of the at least one spray-discharge orifice. The valve needle extends along a longitudinal axis and is linearly movable. A through hole is developed in the magnet armature, in which the valve needle is situated. The magnet armature is linearly movable between a first and a second stop in relation to the valve needle. This creates a two-mass system. The first stop is formed on a side of the magnet armature facing away from the discharge. For example, the first stop is formed by a ring on the valve needle. The second stop is formed on a side of the magnet armature facing the discharge. According to the present invention, the second stop is formed by a stop element and a counter element. The stop element and the counter element strike each other at the second stop. The stop element has a stop face for this purpose. A counter face situated across from the stop face is developed on the counter element. The stop face and counter face strike each other at the second stop. The stop element has an elastic design, so that an angle between the longitudinal axis and stop face changes when the counter face and the stop face strike each other. In particular, the stop face is inclined toward the counter element prior to and following the contact between stop element and counter element. As soon as the counter element and stop element make contact with each other, the stop element is elastically deformed, so that the space between the stop face and counter face becomes smaller. Because of the elastic development of the stop element according to the present invention, it is possible that there is a change in the squish gap and the throttle flow between the stop face and counter face when the stop face and counter face move towards and away from each other. This enables a very precise adjustment of the damping in the opening and closing of the injection valve.

The stop element is preferably permanently connected to the valve needle. The counter element will then be situated on the magnet armature. The counter element in particular is an integral component of the magnet armature. In the most straight-forward case, the counter face is the side of the magnet armature that faces the stop face. In an alternative development, it is possible that the stop element is permanently connected to the magnet armature. The counter element will then be permanently joined to the valve needle. Decisive is that at least one of the opposing surfaces on the second stop has an elastic design. This at least one elastic surface is referred to as stop face within the scope of the present application.

The stop element or counter element is preferably integrated into the valve needle. As an alternative, the stop element or counter element is integrated into the magnet armature.

It is furthermore preferably provided that the angle between the longitudinal axis and stop face without contact between stop face and counter face is less than 90° at least regionally. The angle is defined on the side of the stop face that faces the counter face. This means that the angle of less than 90° defines that the stop face is inclined toward the counter face. It suffices if the stop face has this inclination at the corresponding angle only in certain places. When the counter face strikes the stop face, the stop face will be deformed, so that the angle becomes greater.

When lifting off from the stop face and counter face, i.e., during the opening of the injection valve, the stop element relaxes again, so that the angle becomes smaller again. Because of the development of the angle it is possible that the movement of the magnet armature is damped only by a throttle flow but no squish gap when the injection valve opens. As soon as the counter face and the stop face move slightly apart from each other, the stop element relaxes and the stop face thus inclines in the direction of the counter face. As a result, the stop face and counter face are no longer aligned in parallel with one another, and no squish gap is present. Only a throttle flow, i.e., the flow of the medium to be injected, which flows out of the region between stop face and counter face, dampens the opening movement of the magnet armature.

When the injection valve closes, the stop face and the counter face move toward each other. In so doing, the stop face is initially inclined in the direction of the counter face, so that a relatively large space filled with the medium is present between the stop face and counter face. The movement is initially dampened by a throttle flow, and as soon as the stop face and counter face make contact with each other, the stop face is deformed, so that the stop face aligns itself parallel to the counter face. This creates a squish gap for damping the movement of the magnet armature. The damping effect therefore increases as the clearance between stop face and counter face becomes smaller.

It is provided, in particular, that the angle without the contact between stop face and counter face amounts to maximally 89.99 degrees, preferably maximally 89.85 degrees. As already described earlier, this angle need not be provided across the entire stop face.

It is furthermore preferably provided that as a result of the striking contact between counter face and stop face, the angle is elastically deformed by at least 0.01 degrees, preferably at least by 0.15 degrees. In an especially preferred specific embodiment, the stop face is deformed until the stop face and counter face are in parallel alignment with each other.

It is furthermore advantageous that the stop face is subdivided into an inner section and an outer section. The inner section is closer to the longitudinal axis than the outer section. Especially preferably, the stop face is an annular surface around the valve needle. The inner section is an inner annular surface. The outer section is a further annular surface lying outside of the inner section. The angle without contact between stop face and counter face is larger at the outer section than at the inner section. In this context it is preferably provided that the stop face inclines more heavily in the direction of the counter face as the distance from the longitudinal axis increases.

Especially preferably, it is provided that the inner section without contact between stop face and counter face is developed parallel to the counter face. As an alternative, the inner section may be slightly inclined in the direction of the counter face or have a concave design.

On the stop element, a side facing away from the counter face is referred to as outer surface. This outer surface should also be formed appropriately, so that enough elasticity is available for the deformation of the stop face. As a consequence, the outer surface is preferably formed so that it inclines in the direction of the counter element or is at least regionally concave. As an alternative, the outer surface may regionally also lie parallel to the stop face. It is also decisive in this context that the stop element is as thin as possible, so that the stop face is able to deform elastically.

In order to ensure the elastic deformability of the stop element, and thus also of the stop face, grooves are preferably provided in the stop element. These grooves are especially preferably formed over the entire circumference of the longitudinal axis.

The first stop is preferably formed by a step or by a ring on the valve needle.

Exemplary embodiments of the present invention are described in detail below with reference to the accompanying drawing.

DETAILED DESCRIPTION OF THE INVENTION

In the following text, a first exemplary embodiment of injection valve 1 will be discussed with the aid of FIGS. 1 through 7. Identical components or functionally identical components are designated by identical reference symbols in all exemplary embodiments.

Figure 1:
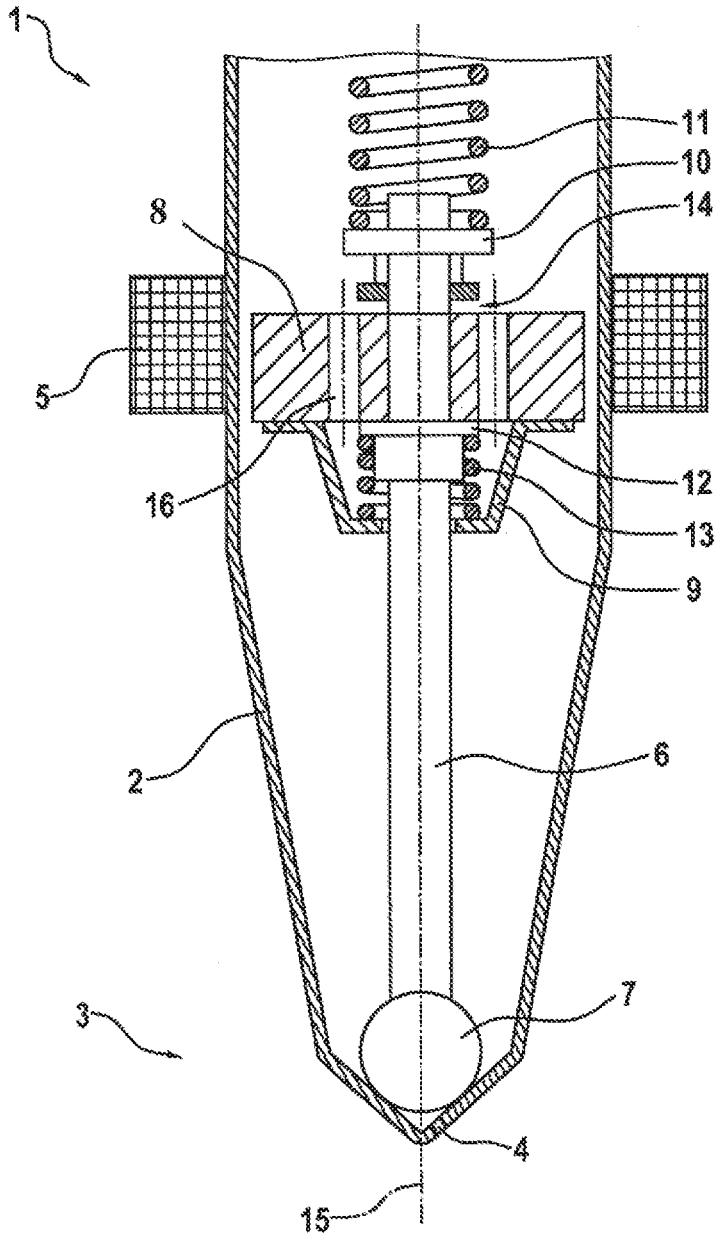
FIG. 1 shows an injection valve according to the present invention for all exemplary embodiments.

FIG. 1 illustrates the general structure of injection valve 1 for all the exemplary embodiments. Injection valve 1 includes a housing 2 having a spray discharge orifice 4 on a discharge side 3. Housing 2 supports a solenoid coil 5. A valve needle 6 including a ball 7 is disposed along a longitudinal axis 15 in the interior of housing 2. Ball 7 together with housing 2 forms a valve seat for opening and closing spray orifice 4.

In addition, a magnet armature 8, which is connected to a spring cup 9, is situated inside housing 2. On a side of magnet armature 8 that faces away from the discharge is a ring 10, which is fixedly secured on valve needle 6. This ring 10 forms a first stop for magnet armature 8. On a side of magnet armature 8 facing the discharge is a stop element 12. This stop element 12 forms a second stop together with magnet armature 5.

Both valve needle 6 and magnet armature 8 are linearly movable along longitudinal axis 15. The movement of magnet armature 8 is delimited by the first and second stop.

A plurality of channels 16 for the medium to be injected are developed in magnet armature 8. In addition or as an alternative, valve needle 6 may also have a hollow design.

Valve needle 6 is loaded in the direction of discharge side 3 by means of a first spring 11. A second spring 13 between spring cup 9 and stop element 12 loads magnet armature 8, likewise in the direction of discharge side 3.

Magnet armature 8 is moved by energizing solenoid coil 5. By way of the first and second stop, magnet armature 8 carries valve needle 6 along. The distance between the two stops defines an armature free travel 14.

Figure 2:
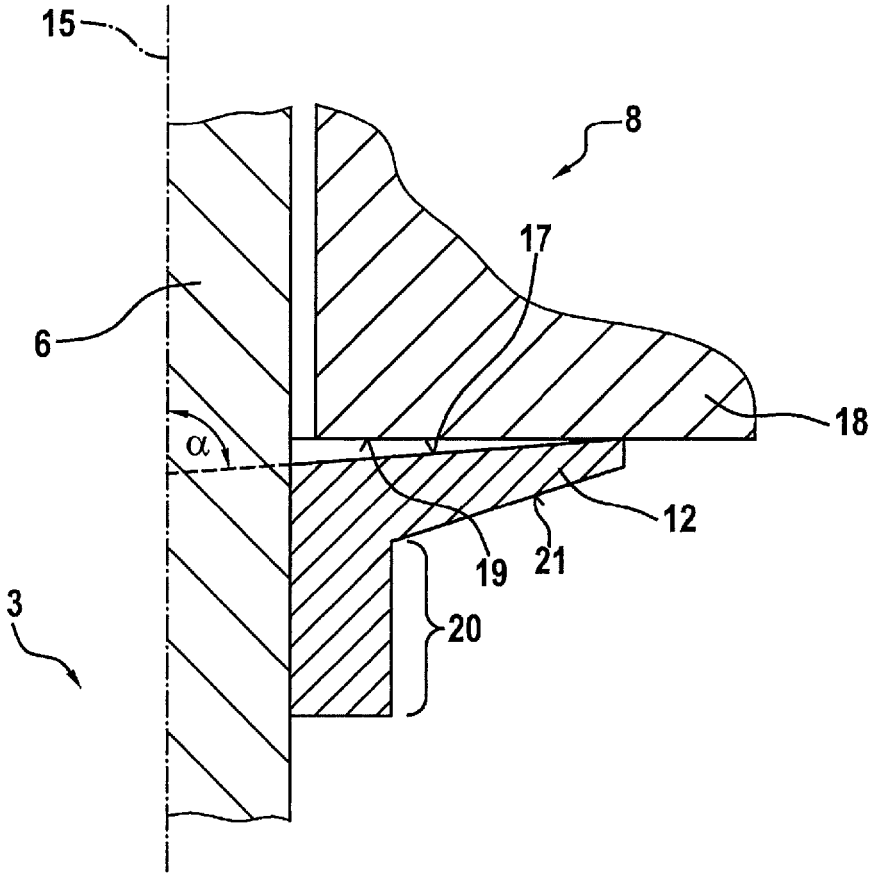
FIG. 2 shows a detail of an injection valve of the present invention, according to a first exemplary embodiment.

FIG. 2 shows a detail of injection valve 1 according to a first exemplary embodiment. It is obvious that stop element 12 is integrally formed with a sleeve 20. Sleeve 20 is situated on valve needle 6 and permanently joined to valve needle 6. Magnet armature 8 is simultaneously developed as so-called counter element 18.

A surface on stop element 12 facing counter element 18 is referred to as stop face 17. Situated across from stop face 17 is a counter face 19 on counter element 18. A side on stop element 12 facing away from counter element 18 is referred to as outer surface 21. The plotted angle $\alpha$ is defined between stop face 17 and longitudinal axis 15. Angle $\alpha$ is measured on the side of stop face 17 facing counter element 18.

Stop element 12, and thus also stop face 17, are elastically deformable. When counter element 18, i.e., magnet armature 8, strikes stop element 12, stop element 12 is elastically deformed, so that angle $\alpha$ becomes larger.

Figure 3:
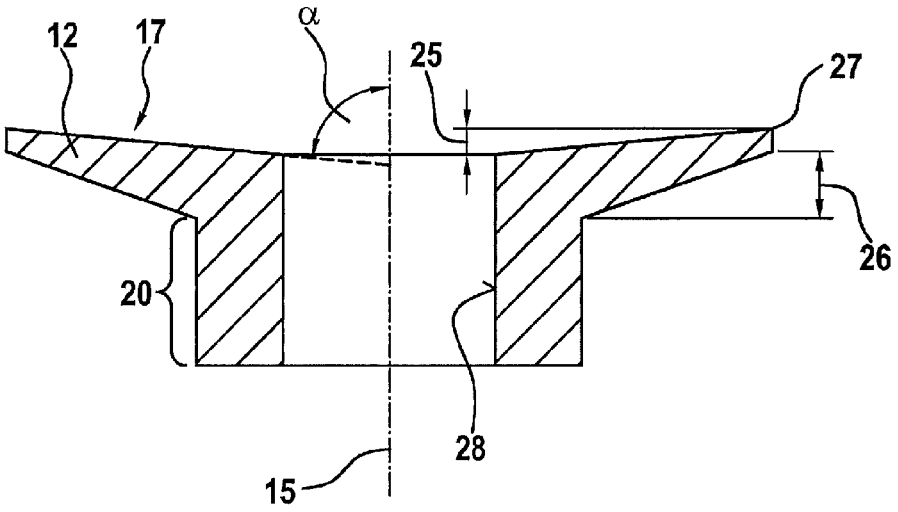
FIG. 3 shows a further detail of an injection valve of the present invention, according to the first exemplary embodiment.

FIG. 3 shows sleeve 20 and stop element 12 in detail. Sleeve 20 and stop element 12 have a through hole 28 that is coaxial with respect to longitudinal axis 15. Valve needle 6 is situated in this through hole 28.

A first height 25 extends parallel to longitudinal axis 15, from the upper end of through hole 28 to the outer end of stop face 17. The outer end of stop face 17 is referred to as peak 27. A second height 26 designates the extension of stop element 12 parallel to longitudinal axis 15. The elasticity of stop face 17 in the illustrated exemplary embodiment is achieved in that the two heights 25, 26 are greater than 0.

Figure 4:
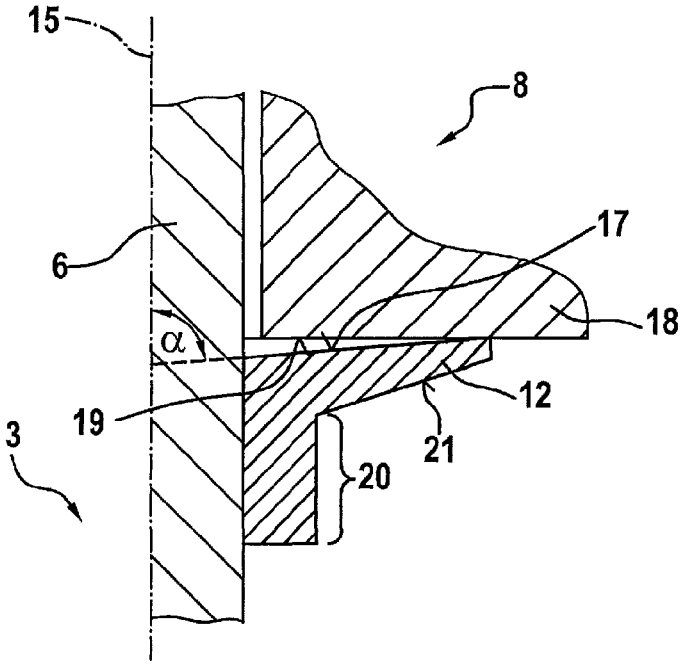
FIGS. 4 through 7 show a movement sequence at the injection valve of the present invention, according to the first exemplary embodiment.

FIGS. 4 through 7 show a movement sequence during the opening and closing of the injection valve. FIG. 4 shows the idle state, in which solenoid coil 5 is not energized and magnet armature 8 merely rests lightly on stop element 12. Accordingly, stop face 17 is not deformed and stop face 17 is inclined toward counter face 19 at an angle $\alpha$ of less than 90 degrees.

In the following figures, reference numeral 29 denotes a throttle flow of the medium to be injected. The dashed illustration of stop element 12 shows the elastic deformation.

Figure 5:
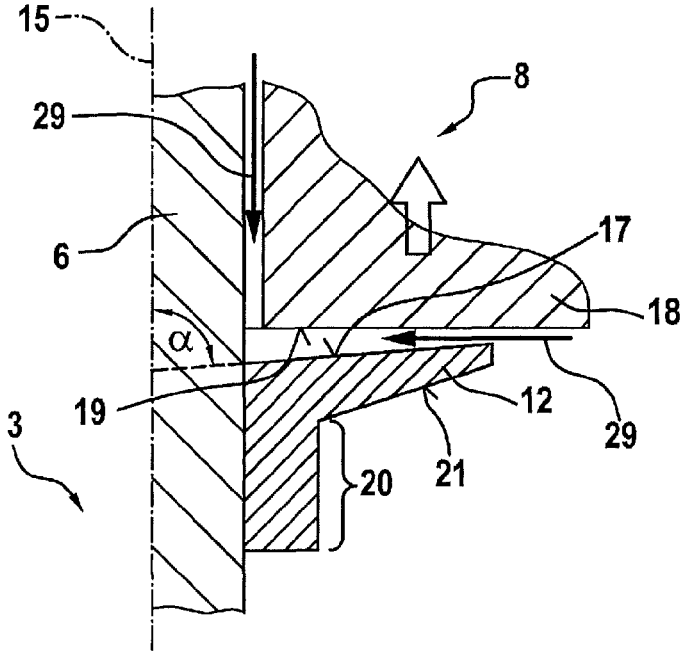
Figure 6:
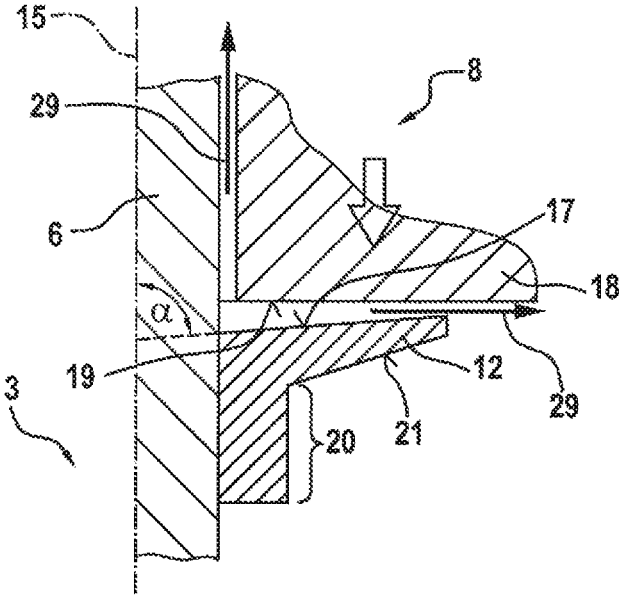
Figure 7:
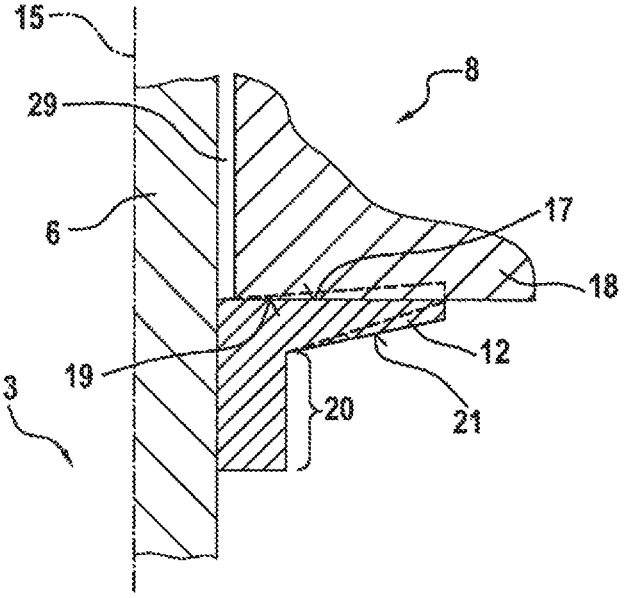

Because of the applied magnetic field at solenoid coil 5, magnet armature 8 is pulled in the direction of the inner pole in FIG. 5, i.e., in the upward direction in the illustration. Valve needle 6 remains in the valve seat, until magnet armature 8 has overcome armature free travel 14 and carries valve needle 6 along via ring 10 (first stop). As long as a relative movement is present between magnet armature 8 and valve needle 6, throttle flow 29 comes about between magnet armature 8 and valve needle 6, i.e., between stop face 17 and counter face 18. Throttle flow 29 between stop face 17 and counter face 19 decreases with rising clearance, so that the injection valve is able to open rapidly. In FIG. 6, the current at solenoid coil 5 is switched off, and the magnetic field decays. Valve needle 6 is in the seat, and magnet armature 8, coming from the first stop on ring 10, is able to continue its movement in the direction of the second stop on stop element 12. Because of the relative movement between magnet armature 8 and valve needle 6, a throttle flow 29 is once again created between stop face 17 and counter face 19. Throttle flow 29 increases with decreasing clearance, so that the movement of magnet armature 8 is damped to a growing extent. When magnet armature 8 makes contact with stop element 12, i.e., counter element 19 exerts pressure on stop face 17, stop element 12 is elastically deformed by the push, and the damping volume situated between stop face 17 and counter face 19 turns into a squish gap. This state is illustrated in FIG. 7. The movement of magnet armature 8 is decelerated as a result. The elastic deformation of stop element 12 aligns stop face 17 in a coplanar manner in relation to counter face 19, so that the damping of the magnet armature movement by the squish gap is maximized.

Figure 8:
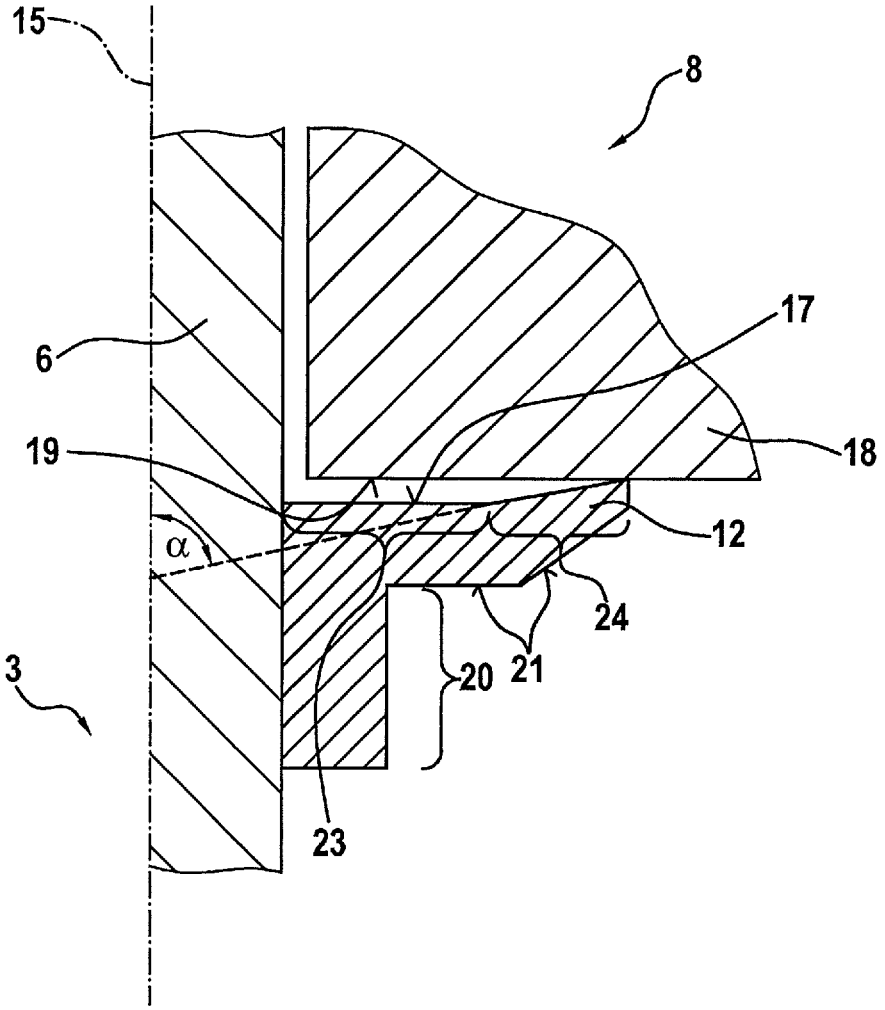
FIG. 8 shows the injection valve of the present invention, according to a second exemplary embodiment.

FIG. 8 shows a detail of injection valve 1 according to a second exemplary embodiment. In the second exemplary embodiment, stop face 17 is subdivided into an inner section 23 and an outer section 24. Even without contact with counter face 19, inner section 23 is disposed perpendicularly to longitudinal axis 15, and thus also in parallel with counter face 19. In outer section 24, stop face 17 is inclined at angle $\alpha$ in the direction of counter face 19.

Outer surface 21 is situated partially in parallel with counter face 19 and partially inclines toward counter face 19. More specifically, outer surface 21 is inclined in the direction of the counter face roughly in the region of outer section 24, so that sufficient elasticity of stop element 12 is provided there.

Figure 9:
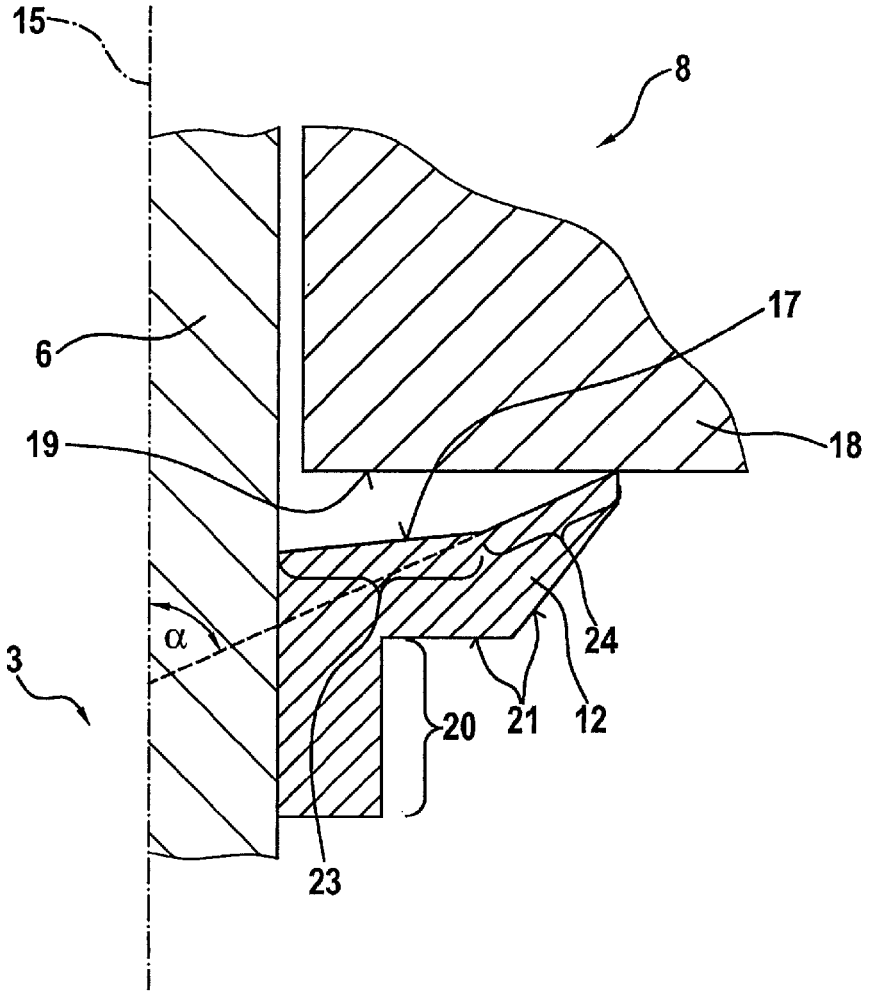
FIG. 9 shows the injection valve of the present invention, according to a third exemplary embodiment.

FIG. 9 shows a detail of injection valve 1 according to a third exemplary embodiment. In the third exemplary embodiment, stop face 17 is inclined in the direction of counter face 19 both in inner section 23 and in outer section 24. However, the inclination toward outer section 24 is more pronounced, so that the greatest deformation of stop element 12 occurs there.

Figure 10:
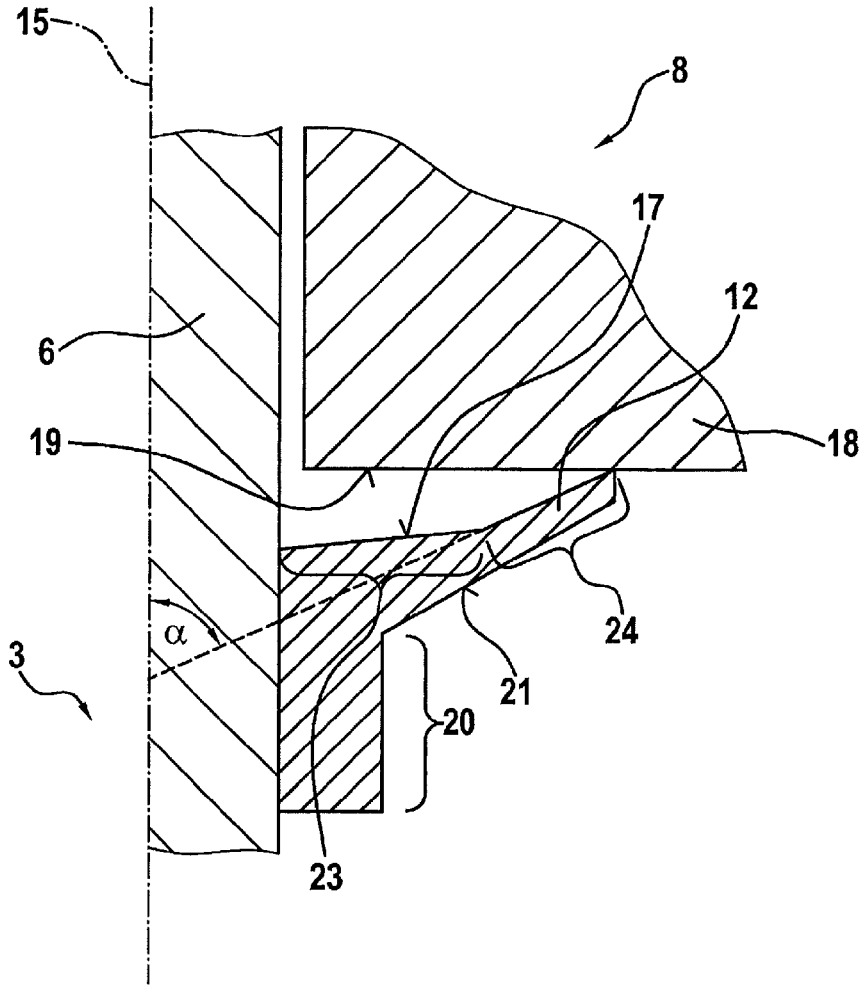
FIG. 10 shows the injection valve of the present invention, according to a fourth exemplary embodiment.

FIG. 10 shows a detail of injection valve 1 according to a fourth exemplary embodiment. In the fourth exemplary embodiment, stop face 17 is inclined in the direction of counter face 19 in inner section 23 and in outer section 24, in the same way as in the third exemplary embodiment. From sleeve 20, outer surface 21 is heavily inclined throughout in the direction of counter face 19. This creates a very narrow stop element 12, especially in the outer region, which is elastically deformable accordingly.

Figure 11:
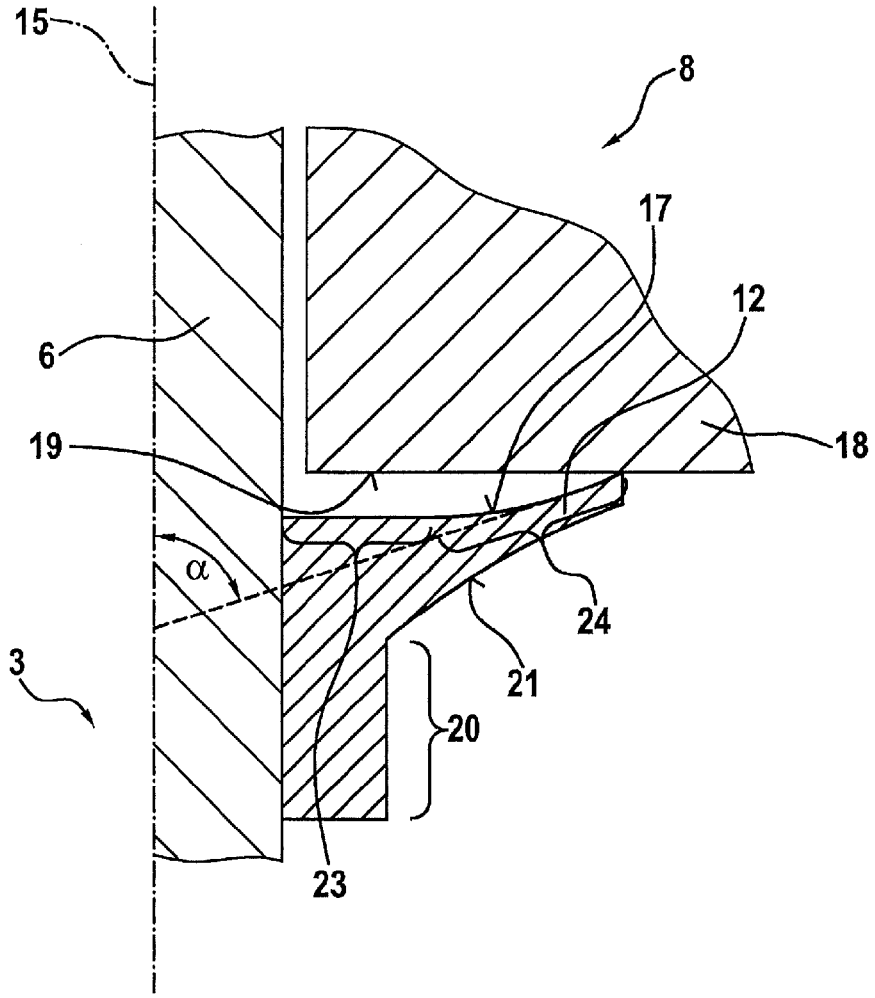
FIG. 11 shows the injection valve of the present invention, according to a fifth exemplary embodiment.

FIG. 11 shows a detail of injection valve 1 according to a fifth exemplary embodiment. In the fifth exemplary embodiment, stop face 17 is disposed parallel to counter face 19 across inner section 23. Stop face 17 is concave along outer section 24. Outer surface 21 of stop element 12 likewise has a concave design. This creates a relatively narrow stop element 12 having rounded transitions between the various inclinations, so that a dependable elasticity is ensured. Angle $\alpha$ is hereby defined by the tangent, is to the concave development of stop face 17 in outer section 24 and longitudinal axis 15.

Figure 12:
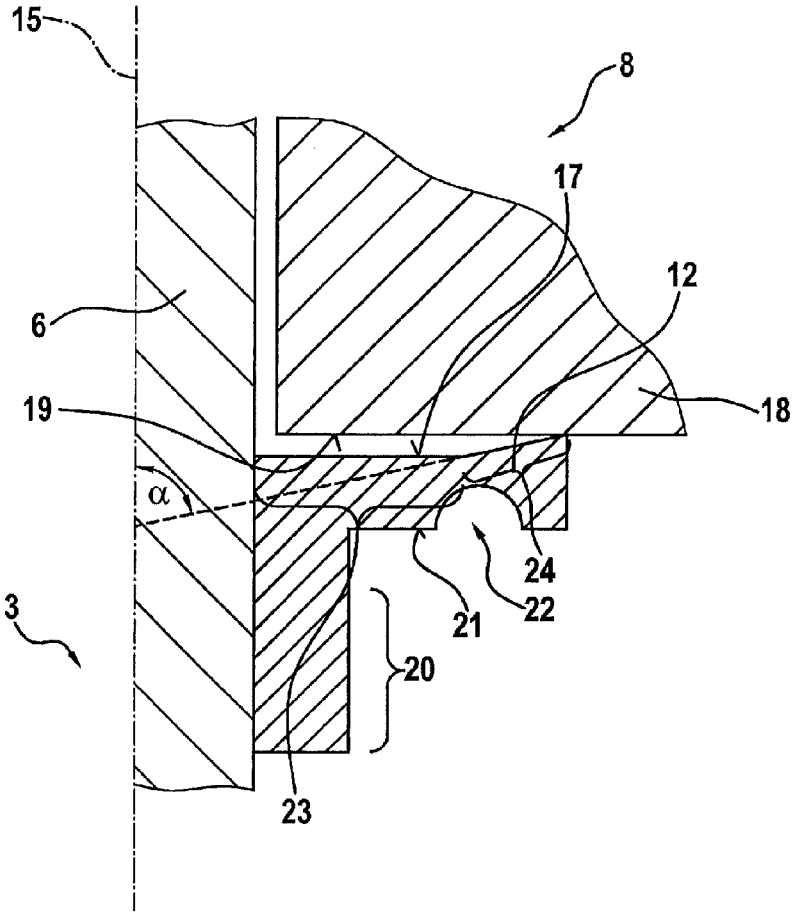
FIG. 12 shows the injection valve of the present invention, according to a sixth exemplary embodiment.

FIG. 12 shows a detail of injection valve 1 according to a sixth exemplary embodiment. In the sixth exemplary embodiment, a groove has been provided in outer surface 21 of stop element 12. This groove 22 is developed peripherally about longitudinal axis 15, in particular. Groove 22 weakens stop element 12 accordingly, so that the desired elasticity is provided.

Figure 13:
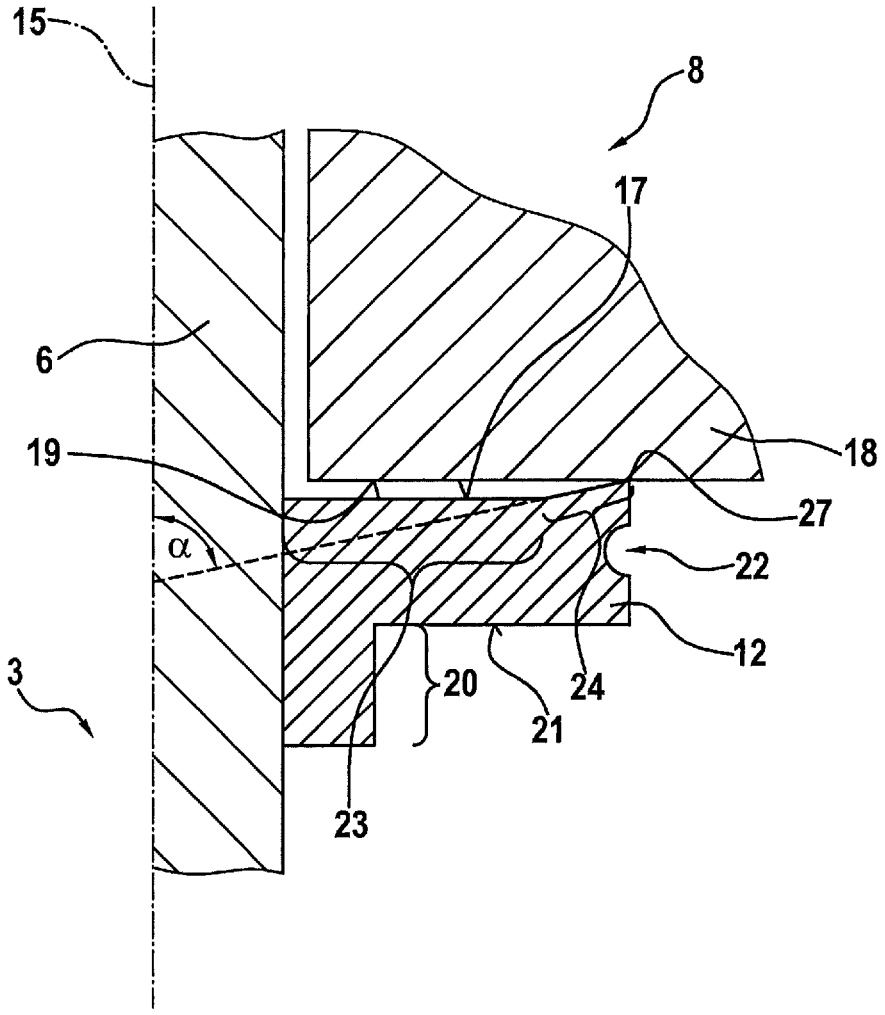
FIG. 13 shows the injection valve of the present invention, according to a seventh exemplary embodiment.

FIG. 13 shows a portion of injection valve 1 according to a seventh exemplary embodiment. Seventh exemplary embodiment once again shows a groove 22 for adjusting the elasticity of stop element 12. In the seventh exemplary embodiment, groove 22 is situated in an area of stop element 12 that extends in parallel with longitudinal axis 15. This has the result that groove 22 comes very close to peak 27 and stop face 17, so that not entire stop element 12 but only an upper portion is deformed in this exemplary embodiment.

The various exemplary embodiments show possible geometries of stop element 12. In the exemplary embodiments, stop faces 17 are usually in the form of a wedge, since the wedge form is easy to measure and produce. The exemplary embodiments may naturally also be combined. For example, grooves 22 shown in FIGS. 12 and 13 with the appropriate form depth and number in the other exemplary embodiments as well. Furthermore, an adaptation of outer surface 21 according to FIGS. 9, 10 and 11 is possible in all exemplary embodiments. The different angles and concave developments of stop face 17 of the various exemplary embodiments can be combined with one another. In addition, all other concave and convex forms of stop element 12 are possible, as long as sufficient elasticity is ensured. Additional cross-sectional forms for groove 22 are triangles and ellipses, for example. Even more than one groove 22 per stop element 12 is possible in order to adapt the stiffness appropriately. The exemplary embodiments show rotationally symmetrical valve needles 6 that are not hollow. In the same way, it is possible to use the present invention with hollow and/or not rotationally symmetrical valve needles 6. Even stop face 17 or counter face 19 need not have a rotationally symmetrical design.

All exemplary embodiments shown illustrate stop face 17 and counter element 19 in a form in which it is fixedly joined to valve needle 6. Accordingly, magnet armature 6 in the exemplary embodiments is defined as counter element 18 having counter face 19. In the same way, it is possible to develop an elastic stop element 12 which is permanently connected to magnet armature 6. Correspondingly, counter element 18 would then be fixedly joined to valve needle 6. In the simplest development, counter face 19 is a planar rigid surface. It is also possible for counter face 19 to have a certain inclination and elasticity.

What is claimed is:

1. An injection valve for injecting fuel into a combustion chamber, comprising a housing having at least one spray discharge orifice on a discharge side;

a solenoid coil;

a magnet armature linearly movable by the solenoid coil;

a valve needle for opening and closing the spray discharge orifice, the valve needle being linearly movable along a longitudinal axis and projecting through the magnet armature, wherein:

the magnet armature is linearly movable in relation to the valve needle between a first stop and a second stop, the second stop is formed by a stop element having a stop face and a counter element provided with a counter face situated across from the stop face, at least part of the stop face is not coplanar with the counter face when the stop face is not in contact with the counter face, the stop element has an elastic configuration so that an angle between the longitudinal axis and the stop face changes when the counter face strikes the stop face, and when the solenoid is energized or shortly after the armature is energized, the armature moves in a direction towards the first stop such that the armature is released entirely from contact with the stop face of the stop element.

2. The injection valve as recited in claim 1, wherein the stop element is permanently connected to the valve needle and the counter element is permanently connected to the magnet armature.

3. The injection valve as recited in claim 2, wherein the angle between the longitudinal axis and the stop face without contact between the stop face and the counter face is at least locally smaller than 90°, the angle being defined on the side of the stop face facing the counter face.

4. The injection valve as recited in claim 3, wherein the angle without contact between the stop face and the counter face is maximally 89.85°.

5. The injection valve as recited in claim 3, wherein the angle is elastically deformed by at least 0.15° as a result of the counter face striking the stop face.

6. The injection valve as recited in claim 3, wherein the stop face is subdivided into an inner section and an outer section, the inner section being situated closer to the longitudinal axis than the outer section, and the angle without contact between the stop face and the counter face is greater at the outer section than at the inner section.

7. The injection valve as recited in claim 6, wherein the inner section without contact between the stop face and the counter face is one of (i) parallel to the counter face, (ii) inclined toward the counter face, or (iii) concave.

8. The injection valve as recited in claim 3, wherein an outer surface of the stop element facing away from the counter face is at least one of (i) locally inclined in relation to the stop face, (ii) locally developed parallel to the stop face, and (iii) locally developed in concave form.

9. The injection valve as recited in claim 3, wherein the stop element has at least one circumferential groove.

10. The injection valve as recited in claim 3, wherein the first stop is formed by one of a ring or a step on the valve needle.

11. The injection valve as recited in claim 1, wherein the stop face and the counter face are not in contact only when the solenoid coil is excited or shortly after energization of the solenoid coil has ended.

12. The injection valve as recited in claim 1, wherein, the magnetic armature returns to the stop element until making contact with the stop element after the energization of the solenoid coil has ended.

13. The injection valve as recited in claim 1, wherein in a non-excited state of the solenoid coil, the magnetic armature rests permanently against the stop element.

* * * * *